US010531734B1

(12) United States Patent
Brauer

(10) Patent No.: US 10,531,734 B1
(45) Date of Patent: Jan. 14, 2020

(54) MOBILE TRAY FOR USE WITH A BED OR CHAIR

(71) Applicant: Dale Brauer, Girard, KS (US)

(72) Inventor: Dale Brauer, Girard, KS (US)

( * ) Notice: Subject to any disclaimer, the term of this patent is extended or adjusted under 35 U.S.C. 154(b) by 0 days.

(21) Appl. No.: 15/997,807

(22) Filed: Jun. 5, 2018

(51) Int. Cl.
*A47B 23/00* (2006.01)
*A47B 23/04* (2006.01)
*A47B 9/20* (2006.01)

(52) U.S. Cl.
CPC ..... *A47B 23/046* (2013.01); *A47B 9/20* (2013.01); *A47B 2023/047* (2013.01)

(58) Field of Classification Search
CPC ..... A47B 23/00; A47B 23/04; A47B 23/046; A47B 9/20; A47B 2023/047
See application file for complete search history.

(56) References Cited

U.S. PATENT DOCUMENTS 1,290,072 A 1/1919 Bullock
2,480,233 A * 8/1949 Fuller ..... A47B 23/046 108/23
2,848,290 A * 8/1958 Doty ..... A47B 23/046 108/10
3,525,492 A * 8/1970 Kaufman ..... A47B 23/046 108/115
5,615,856 A * 4/1997 Simington ..... A47B 23/007 248/451
5,671,900 A * 9/1997 Cutler ..... A47B 23/007 248/448
5,971,344 A 10/1999 Ainsworth
5,979,857 A * 11/1999 Holm ..... A47B 23/046 248/124.1
D467,754 S 12/2002 Chen
6,742,755 B2 6/2004 Pryor
6,796,536 B1 9/2004 Sevier, IV
7,118,080 B2 * 10/2006 Chan ..... A47B 23/046 248/129
8,100,061 B2 1/2012 Hookway
9,642,455 B1 * 5/2017 Albert ..... A47B 23/046
2002/0017595 A1 * 2/2002 Koyanagi ..... A47B 23/04 248/122.1
2014/0360412 A1 * 12/2014 Zaccai ..... A47B 83/045 108/50.11
2015/0374117 A1 * 12/2015 Lozano ..... A47B 19/06 320/107

* cited by examiner

*Primary Examiner* — Brian L Swenson
(74) *Attorney, Agent, or Firm* — Kyle A. Fletcher, Esq.

(57) ABSTRACT

The mobile tray for a bed or a chair is adapted for use with a furniture item selected from the group consisting of a bed or a chair. The mobile tray for a bed or a chair mounts on a wheeled base. The mobile tray for a bed or a chair is a table that mounts on a vertically telescopic stanchion such that the vertical span of the table from a supporting surface is adjustable. The table pivots for storage. The support of the mobile tray for a bed or a chair is designed to fit underneath the furniture item while the table is accessible from the item of furniture.

19 Claims, 7 Drawing Sheets

MOBILE TRAY FOR USE WITH A BED OR CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal or domestic articles including furniture, more specifically, a suspended serving or lap tray.

SUMMARY OF INVENTION

The mobile tray for a bed or a chair is adapted for use with a furniture item selected from the group consisting of a bed or a chair. The mobile tray for a bed or a chair mounts on a wheeled base. The mobile tray for a bed or a chair is a table that mounts on a vertically telescopic stanchion such that the vertical span of the table from a supporting surface is adjustable. The table pivots for storage. The support of the mobile tray for a bed or a chair is designed to fit underneath the furniture item while the table is accessible from the item of furniture.

These together with additional objects, features and advantages of the mobile tray for a bed or a chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the mobile tray for a bed or a chair in detail, it is to be understood that the mobile tray for a bed or a chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mobile tray for a bed or a chair.

It is therefore important that the claims be regarded as including such equivalent construction insofar as they do not depart from the spirit and scope of the mobile tray for a bed or a chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
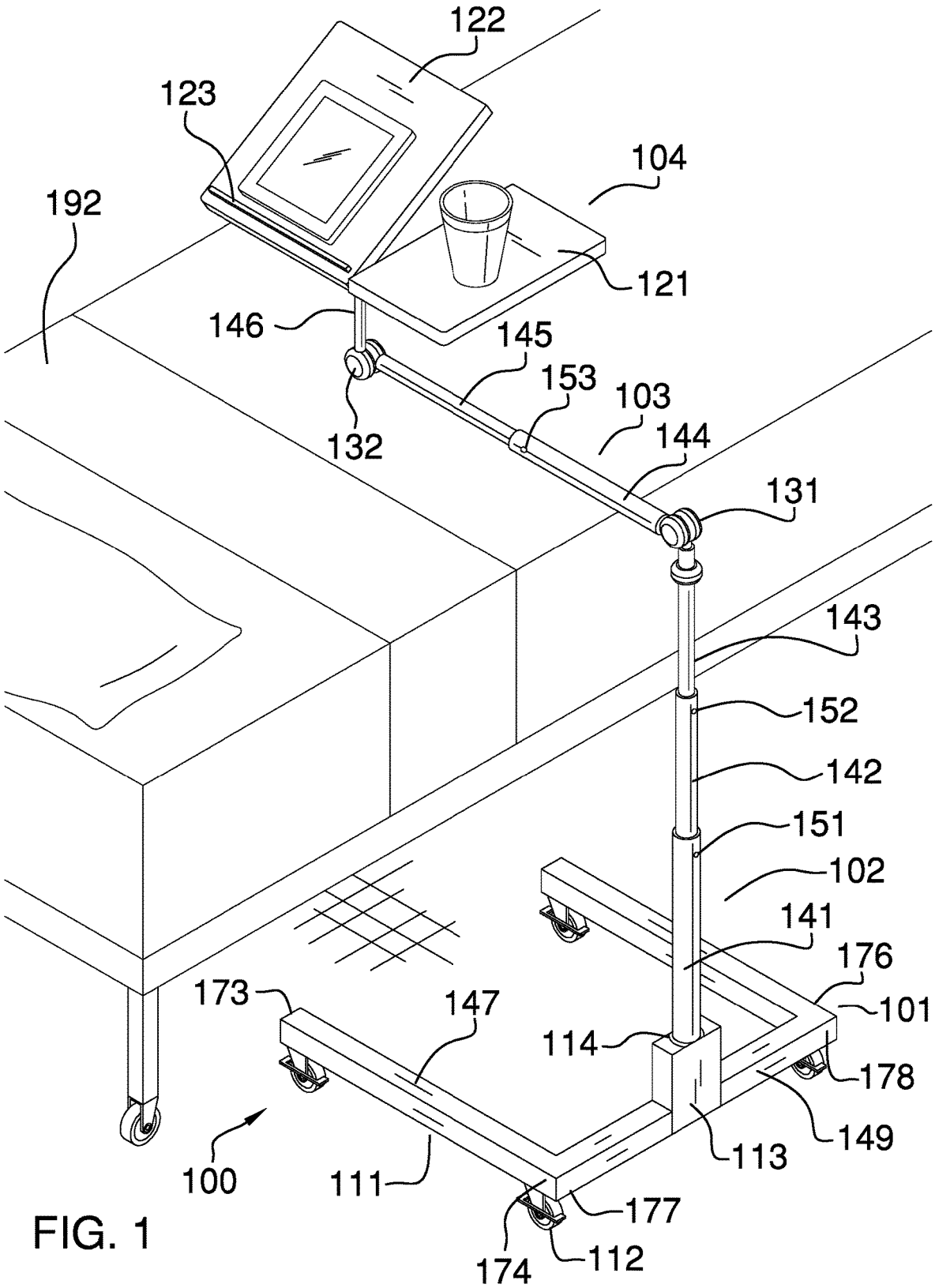
FIG. 1 is a perspective view of an embodiment of the disclosure.
Figure 2:
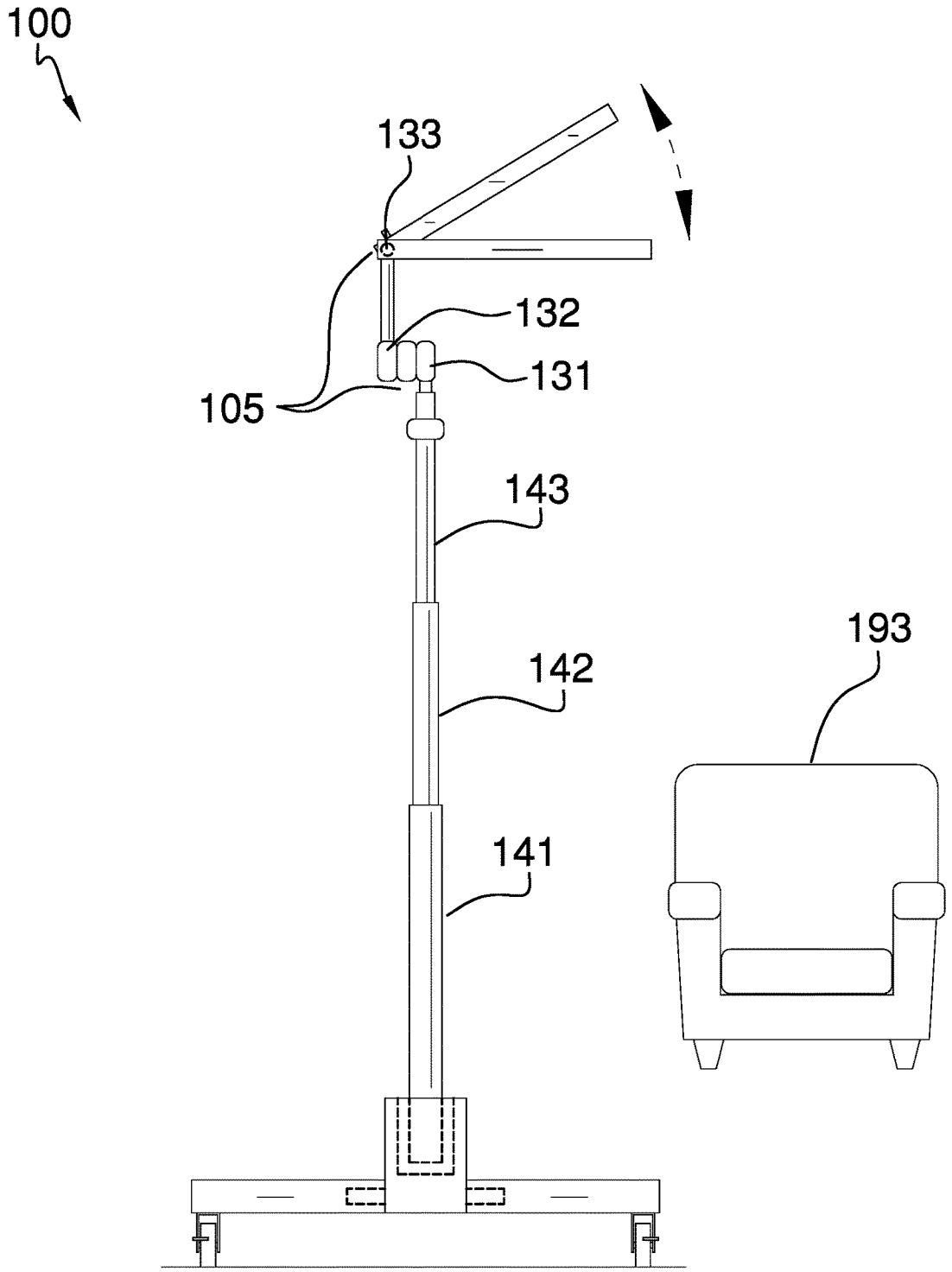
FIG. 2 is a side view of an embodiment of the disclosure.
Figure 3:
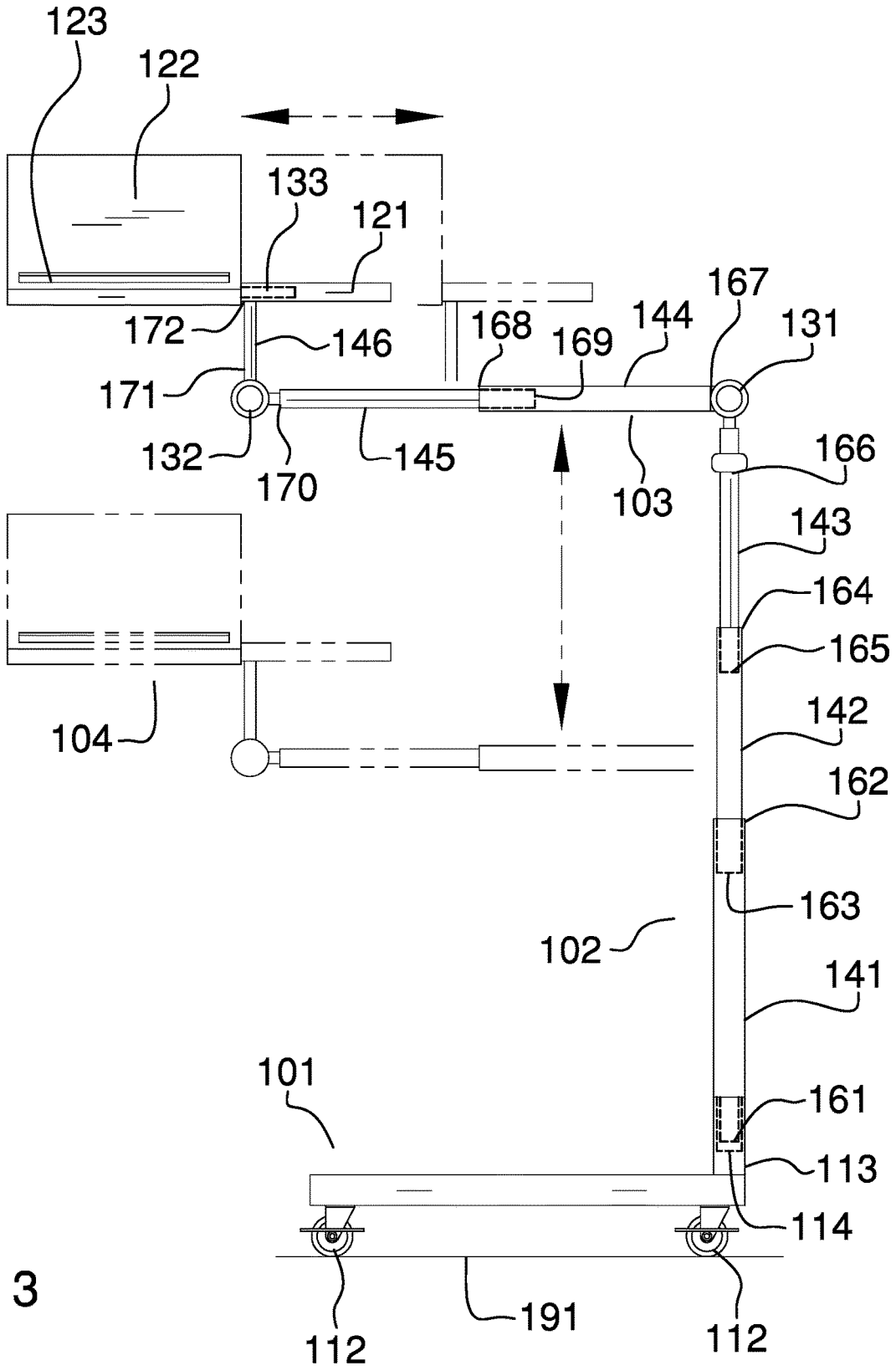
FIG. 3 is a front view of an embodiment of the disclosure.
Figure 4:
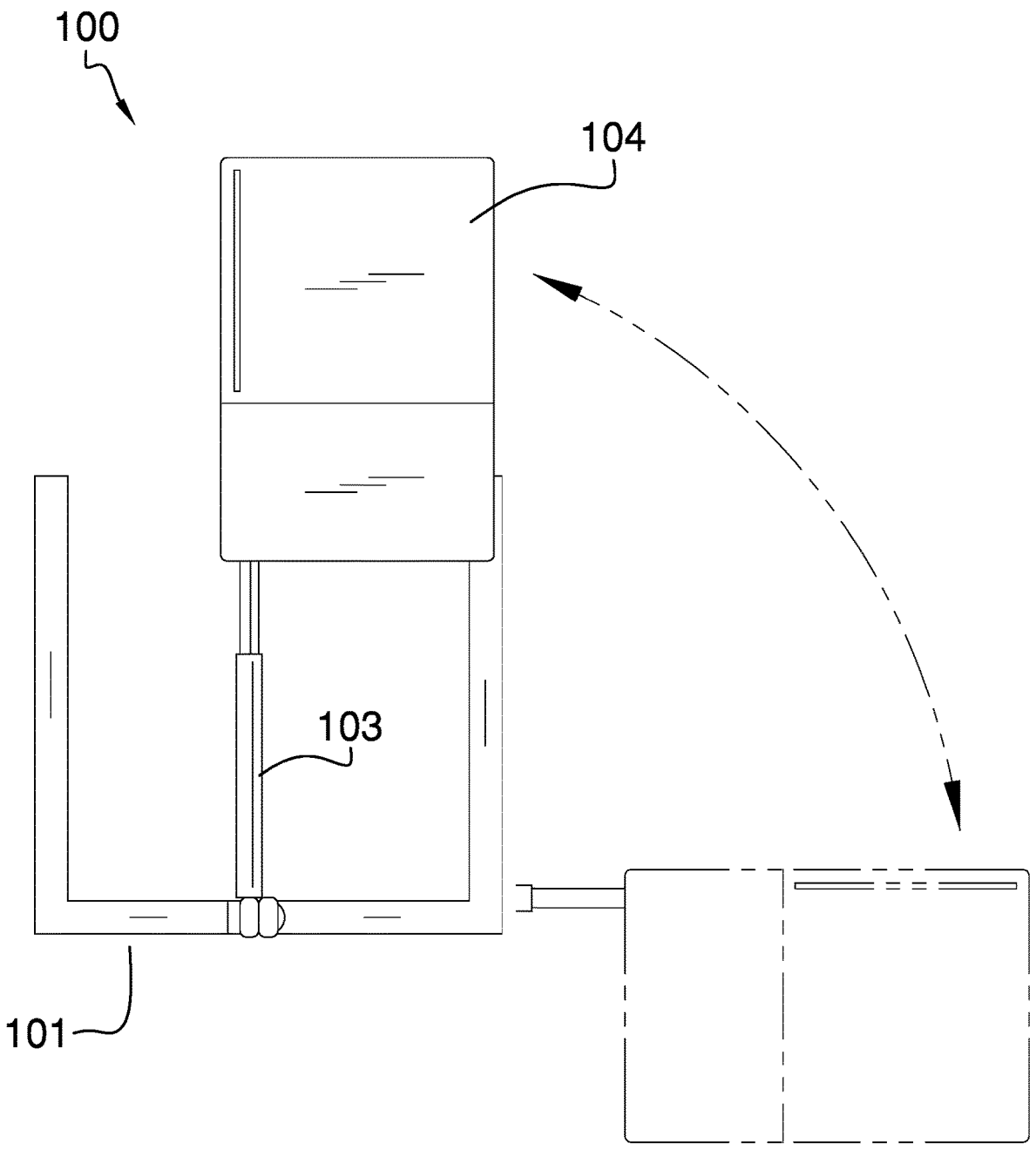
FIG. 4 is a top view of an embodiment of the disclosure.
Figure 5:
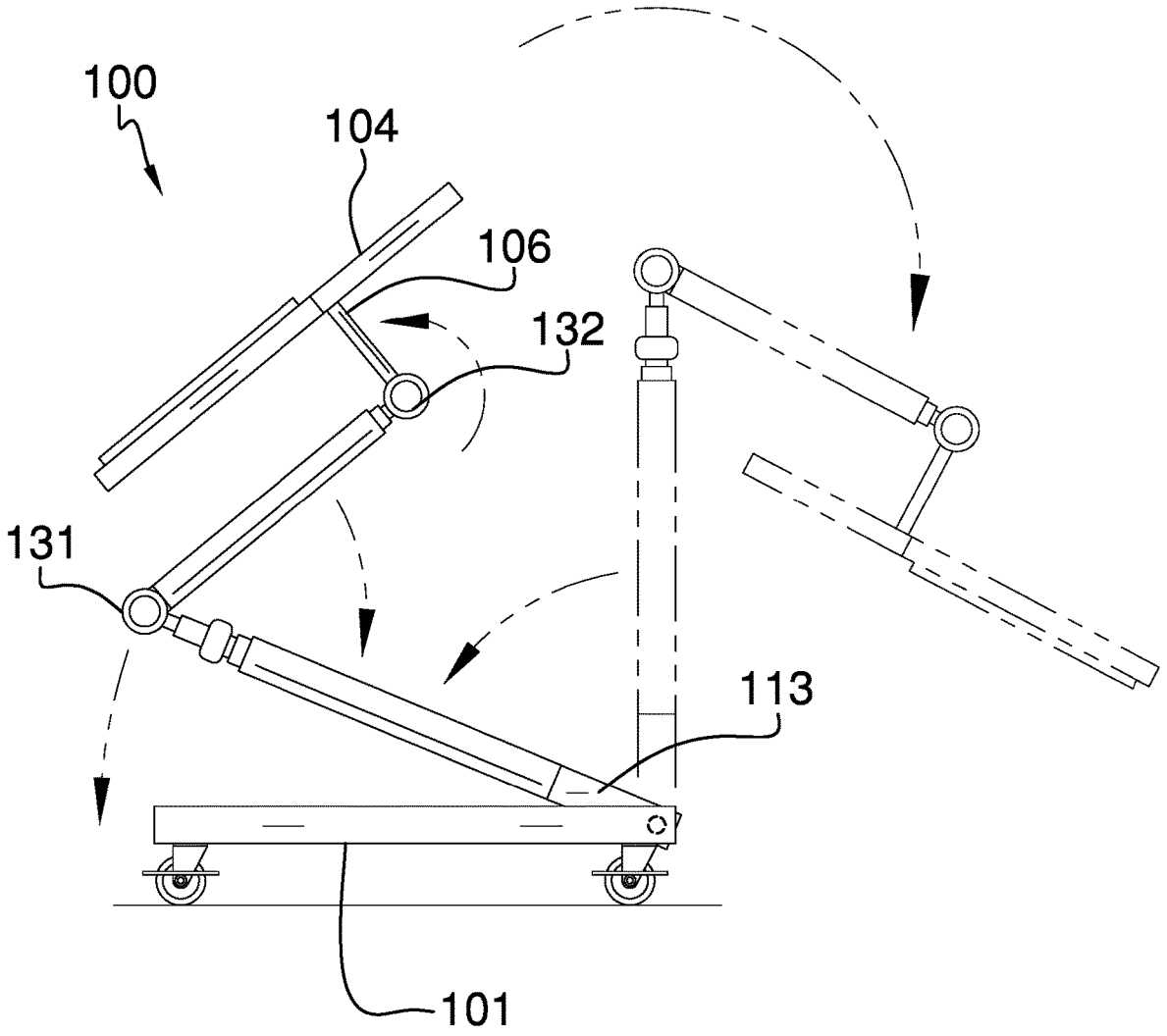
FIG. 5 is a collapsed view of an embodiment of the disclosure.
Figure 6:
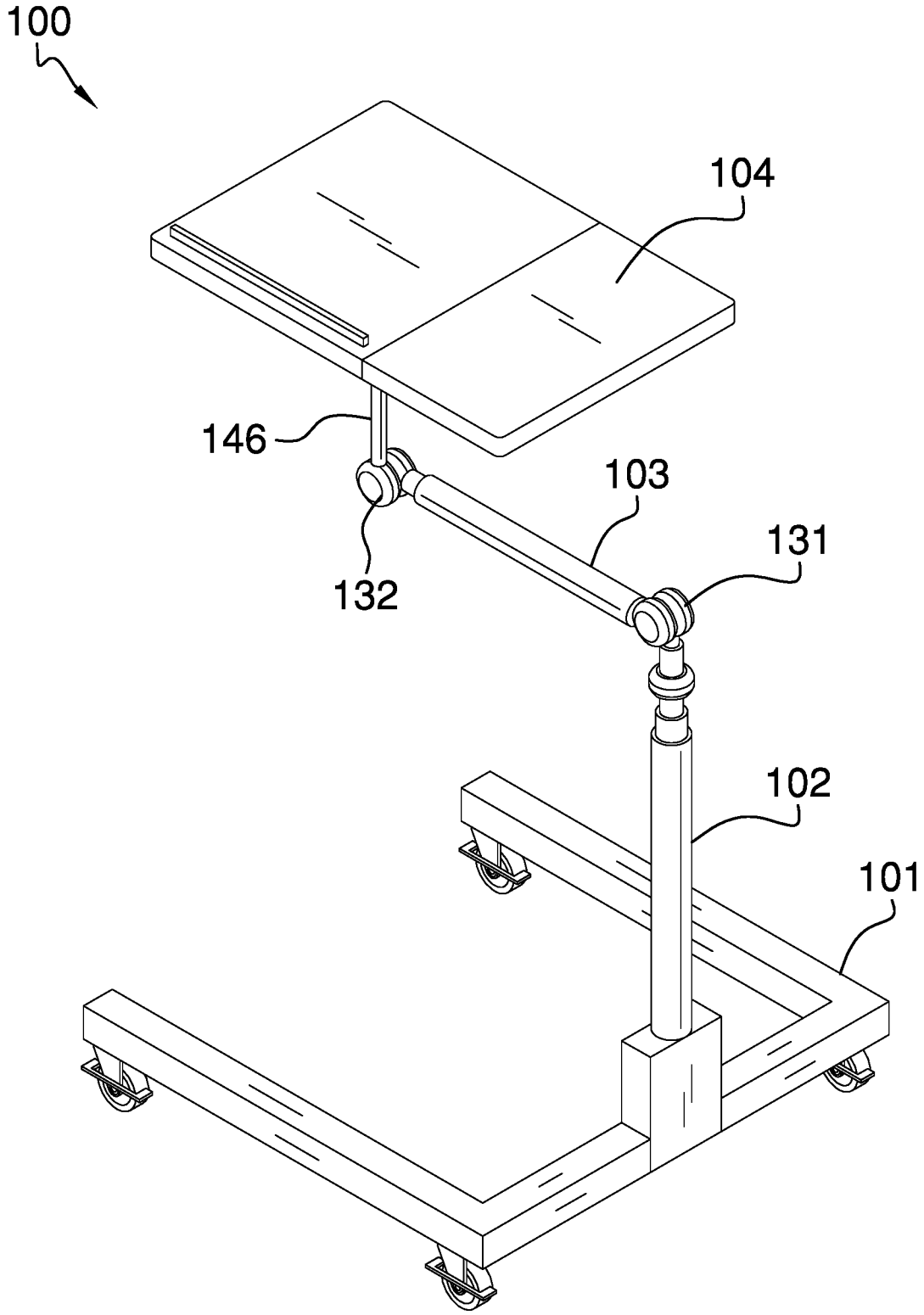
FIG. 6 is a collapsed view of an embodiment of the disclosure.
Figure 7:
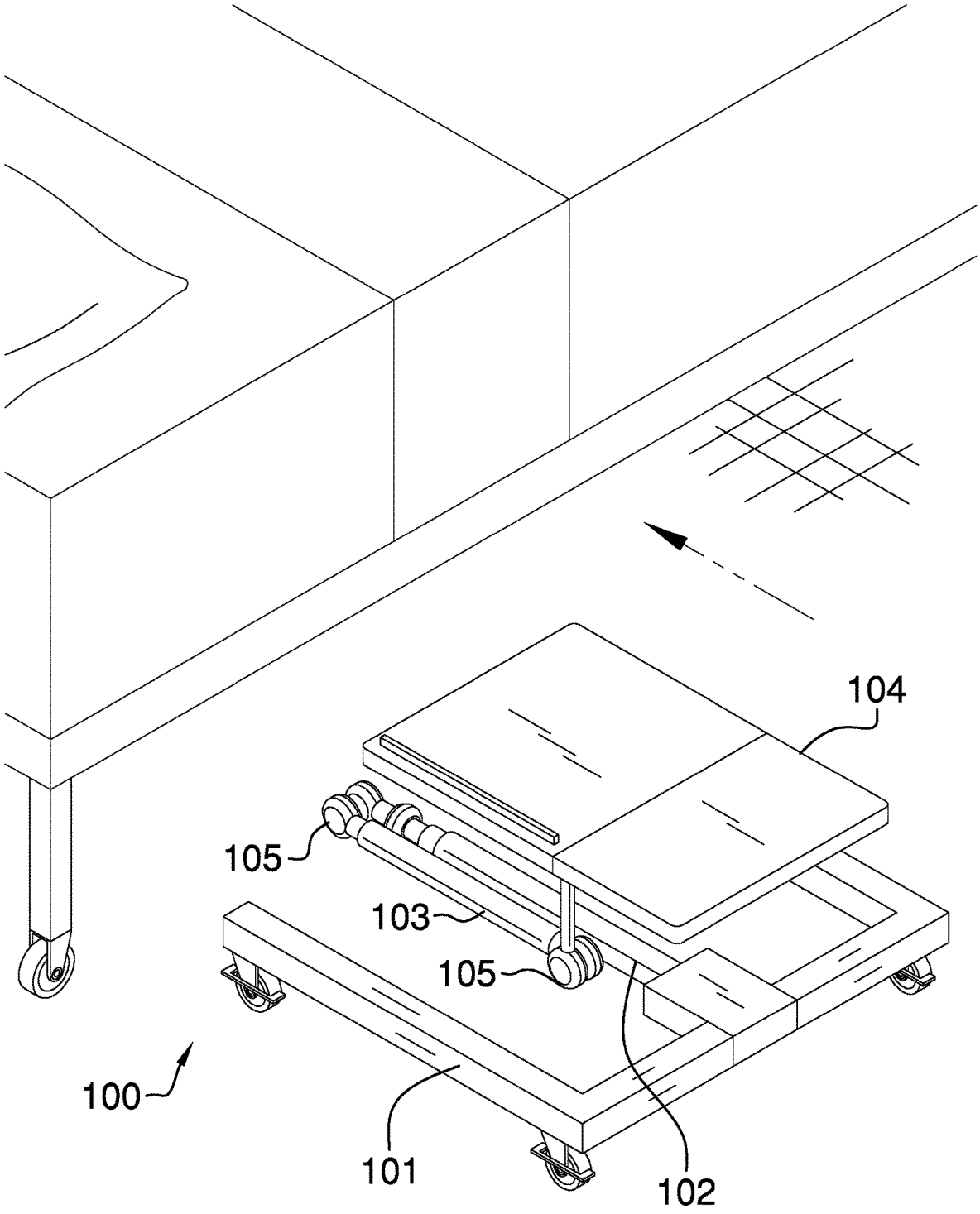
FIG. 7 is a collapsed view of an embodiment of the disclosure.

Detailed reference will now be made to one or more potential embodiments of the disclosure, which are illustrated in FIGS. 1 through 7.

The mobile tray for a bed or a chair 100 (hereinafter invention) is adapted for use with a furniture item selected from the group consisting of a bed 192 and a chair 193. The invention 100 mounts on a wheeled base 101. The invention 100 is a table 104 mounted on a vertically telescopic stanchion 102 such that the vertical span of the table 104 as measured from a supporting surface 191 adjusts. The table 104 pivots for storage. The wheeled base 101 of the invention 100 is designed to fit underneath the furniture item while the table is accessible from the item of furniture. The invention 100 comprises the wheeled base 101, the stanchion 102, a gusset 103, the table 104, and a plurality of pivots 105. The plurality of pivots 105: a) attach the gusset 103 to the stanchion 102; and, b) the table 104 to the gusset 103. The gusset 103 provides for lateral adjustments of the table 104 after the stanchion 102 is set.

The wheeled base 101 is a pedestal structure. The wheeled base 101 transfers the load path of the invention 100 to a supporting surface 191. The wheeled base 101 is a rolling structure. The wheeled base 101 rolls underneath a furniture item selected from the group consisting of a bed 192 and a chair 193 such that the table 104 can be positioned directly in front of a person resting in the selected furniture item. The wheeled base 101 comprises a hyoid 111, a plurality of casters 112, and a stanchion mount 113. The stanchion mount 113 further comprises a stanchion cavity 114.

The hyoid 111 comprises a seventh arm 147, an eighth arm 148, and a crossbeam 149. The seventh arm 147 is further defined with a thirteenth end 173 and a fourteenth end 174. The eighth arm 148 is further defined with a fifteenth end 175 and a sixteenth end 176. The crossbeam 149 is further defined with a seventeenth end 177 and an eighteenth end 178.

The hyoid 111 forms the primary structure of the wheeled base 101. The hyoid 111 has a U shaped structure characteristic of a hyoid 111 shape. The U shape of the hyoid 111 allows the wheeled base 101 to roll around the legs of a furniture item selected from the group consisting of a bed 192 and a chair 193 during the positioning of the table 104.

The seventh arm 147 is a commercially available rectangular block. The seventh arm 147 attaches to the crossbeam 149 in the manner of a cantilever. The eighth arm 148 is a commercially available rectangular block. The eighth arm 148 attaches to the crossbeam 149 in the manner of a cantilever. The crossbeam 149 is a commercially available rectangular block. The crossbeam 149 attaches seventh arm 147 to the eighth arm 148.

Each of the plurality of casters 112 is a caster that attaches to the inferior surface of the hyoid 111. The plurality of casters 112 transfers the load path of the invention 100 from the hyoid 111 to the supporting surface 191. The plurality of casters 112 are commercially available structures that allow the invention 100 to roll into position.

The stanchion mount 113 attaches the stanchion 102 to the hyoid 111 of the wheeled base 101. The stanchion mount 113 is a rectangular block structure. The stanchion mount 113 attaches to the crossbeam 149 of the hyoid 111. The stanchion mount 113 is a rotating structure. The stanchion mount 113 rotates such that the stanchion 102 rotates from a position perpendicular to the hyoid 111 to a position parallel to the hyoid 111.

The stanchion cavity 114 is a cavity formed in the stanchion mount 113. The stanchion cavity 114 is geometrically similar to the first arm 141 of the stanchion 102 such that the stanchion 102 inserts into the stanchion cavity 114 to attach the stanchion 102 to the wheeled base 101.

The stanchion 102 forms the primary vertical support of the invention 100. The stanchion 102 is an extension apparatus. The span of the length of the stanchion 102 is adjustable such that the elevation of the table 104 adjusts by adjusting the span of the length of the stanchion 102. The stanchion 102 is a telescopic structure. The stanchion 102 attaches the gusset 103 to the wheeled base 101. The stanchion 102 rotates relative to the wheeled base 101. Specifically, the stanchion 102 rotates from a position perpendicular to the hyoid 111 of the wheeled base 101 to a position parallel to the hyoid 111. The rotation of the stanchion 102 allows the elevation of the invention 100 to collapse for storage underneath a furniture item selected from the group consisting of a bed 192 and a chair 193.

The stanchion 102 comprises a first arm 141, a second arm 142, a third arm 143, a first detent 151, and a second detent 152. The first arm 141 is further defined with a first end 161 and a second end 162. The second arm 142 is further defined with a third end 163 and a fourth end 164. The third arm 143 is further defined with a fifth end 165 and a sixth end 166.

The stanchion 102 is a telescopic structure that comprises the first arm 141, the second arm 142, the third arm 143, the first detent 151, and the second detent 152. The first detent 151 attaches the first arm 141 to the second arm 142. The second detent 152 attaches the second arm 142 to the third arm 143. The first arm 141 is a hollow prism that is further defined with an inner dimension. The second arm 142 is a hollow prism that is further defined with an inner dimension and an outer dimension. The third arm 143 is a hollow prism that is further defined with an outer dimension. The second arm 142 is geometrically similar to the first arm 141. The third arm 143 is geometrically similar to the second arm 142.

The span of the outer dimension of the second arm 142 is lesser than the span of the inner dimension of the first arm 141 such that the second arm 142 inserts into the first arm 141 in a telescopic fashion. The span of the outer dimension of the third arm 143 is lesser than the span of the inner dimension of the second arm 142 such that the third arm 143 inserts into the second arm 142 in a telescopic fashion.

This telescopic arrangement of the stanchion 102 allows the length of the stanchion 102 to adjust by adjusting the relative position of the second arm 142 within the first arm 141. This telescopic arrangement of the stanchion 102 further allows the length of the stanchion 102 to adjust by adjusting the relative position of the third arm 143 within the second arm 142.

The position of the second arm 142 relative to the first arm 141 is held in position using the first detent 151. The position of the third arm 143 relative to the second arm 142 is held in position using the second detent 152. The first detent 151 is a mechanical device that locks and secures the second arm 142 to the first arm 141. The second detent 152 is a mechanical device that locks and secures the third arm 143 to the second arm 142. The first detent 151 is selected from the group consisting of a cotter pin, a G snap collar, a cam lock collar, a threaded clutch, a split collar lock, or a spring loaded ball lock. The second detent 152 is selected from the group consisting of a cotter pin, a G snap collar, a cam lock collar, a threaded clutch, a split collar lock, or a spring loaded ball lock.

The gusset 103 is an extension apparatus. The span of the length of the gusset 103 is adjustable such that the span of the lateral distance between the table 104 and the stanchion 102 adjusts by adjusting the span of the length of the gusset 103. The gusset 103 is a telescopic structure. The gusset 103 attaches the table 104 to the stanchion 102. The gusset 103 rotates relative to the stanchion 102 such that a cant is formed between the center axis of the stanchion 102 and the center axis of the gusset 103. The gusset 103 rotates to a position parallel to the stanchion 102 during the collapsing process for storage of the invention 100 underneath the furniture item selected from the group consisting of a bed 192 and a chair 193.

The gusset 103 comprises a fourth arm 144, a fifth arm 145, and a third detent 153. The fourth arm 144 is further defined with a seventh end 167 and an eighth end 168. The fifth arm 145 is further defined with a ninth end 169 and a tenth end 170.

The gusset 103 is a telescopic structure that comprises the fourth arm 144, the fifth arm 145, and the third detent 153. The third detent 153 attaches the fourth arm 144 to the fifth arm 145. The fourth arm 144 is a hollow prism that is further defined with an inner dimension. The fifth arm 145 is a hollow prism that is further defined with an outer dimension. The fifth arm 145 is geometrically similar to the fourth arm 144. The span of the outer dimension of the fifth arm 145 is lesser than the span of the inner dimension of the fourth arm 144 such that the fifth arm 145 inserts into the fourth arm 144 in a telescopic fashion. This telescopic arrangement of the gusset 103 allows the length of the gusset 103 to adjust by adjusting the relative position of the fifth arm 145 within the fourth arm 144.

The position of the fifth arm 145 relative to the fourth arm 144 is held in position using the third detent 153. The third detent 153 is a mechanical device that locks and secures the fifth arm 145 to the fourth arm 144. The third detent 153 is selected from the group consisting of a cotter pin, a G snap collar, a cam lock collar, a threaded clutch, a split collar lock, or a spring loaded ball lock.

The table 104 forms a plurality of work surfaces used by the person confined to the furniture item selected from the group consisting of a bed 192 and a chair 193. The design of the invention 100 allows for the precise positioning of the table 104 relative to the selected furniture item. The table 104 comprises a horizontal plate 121, a canted plate 122, a lip 123, and a sixth arm 146. The sixth arm 146 is further defined with an eleventh end 171 and a twelfth end 172.

The sixth arm 146 is a commercially available cylindrical shaft structure.

The horizontal plate 121 is a rectangular plate structure. The horizontal plate 121 attaches to the sixth arm 146 such that the horizontal plate 121 will not rotate relative to the sixth arm 146. The intention of the horizontal plate 121 is to form a stable horizontal surface suitable for receiving a beverage. The canted plate 122 is a rectangular plate structure. The third pivot 133 of the plurality of pivots 105 attaches the canted plate 122 to the horizontal plate 121 such that the canted plate 122 rotates relative to the horizontal plate 121. The intention of the canted plate 122 is to receive reading materials. The reading angle of reading materials positioned on the canted plate 122 adjusts by using the third pivot 133 to adjust the cant between the canted plate 122 and the horizontal plate 121.

The lip 123 is a rim formed on the superior surface of the canted plate 122. The intention of the lip 123 is to prevent objects from falling off the canted plate 122 when a cant exists between the horizontal plate 121 and the canted plate 122.

Each of the plurality of pivots 105 is a fastening device. Each of the plurality of pivots 105 fastens a first object to a second object such that the cant between the first object and the second object is adjustable. Each of the plurality of pivots 105 is a locking fastener such that the desired cant between the first object and the second object can lock into position. The plurality of pivots 105 comprises a first pivot 131, a second pivot 132, and a third pivot 133.

The first pivot 131 is a commercially available locking universal joint. The first pivot 131 attaches the stanchion 102 to the gusset 103 such that the cant adjusts between the center axis of the stanchion 102 and the center axis of the gusset 103. The first pivot 131 locks the cant between the stanchion 102 and the gusset 103 into a fixed position.

The second pivot 132 is a commercially available locking universal joint. The second pivot 132 attaches the gusset 103 to the sixth arm 146 such that the cant adjusts between the center axis of the gusset 103 and the center axis of the sixth arm 146. The second pivot 132 locks the cant between the gusset 103 and the sixth arm 146 into a fixed position.

The third pivot 133 is a commercially available locking hinge. The third pivot 133 attaches the horizontal plate 121 to the canted plate 122 such that the cant adjusts between the superior surface of the horizontal plate 121 and the superior surface of the canted plate 122. The third pivot 133 locks the cant between the horizontal plate 121 and the canted plate 122 into a fixed position.

The following six paragraphs describe the assembly of the invention 100.

The first pivot 131 attaches the stanchion 102 to the gusset 103 such that the cant between the center axis of the stanchion 102 and the center axis of the gusset 103 is adjustable. The second pivot 132 attaches the gusset 103 to the sixth arm 146 such that the cant between the center axis of the gusset 103 and the center axis of the sixth arm 146 is adjustable. The third pivot 133 attaches the horizontal plate 121 to the canted plate 122 such that the superior face of the canted plate 122 rotates relative the superior face of the horizontal plate 121.

The first end 161 of the first arm 141 inserts into the stanchion cavity 114 of the stanchion mount 113. The third end 163 of the second arm 142 inserts into the second end 162 of the first arm 141. The fifth end 165 of the third arm 143 inserts into the fourth end 164 of the second arm 142. The first pivot 131 attaches the sixth end 166 of the third arm 143 to the seventh end 167 of the fourth arm 144.

The ninth end 169 of the fifth arm 145 inserts into the eighth end 168 of the fourth arm 144. The second pivot 132 attaches the tenth end 170 of the fifth arm 145 to the eleventh end 171 of the sixth arm 146.

The twelfth end 172 of the sixth arm 146 attaches to the horizontal plate 121 of the table 104. The third pivot 133 attaches the horizontal plate 121 of the table 104 to the canted plate 122 of the table 104.

The thirteenth end 173 of the seventh arm 147 is free. The fourteenth end 174 of the seventh arm 147 attaches to the seventeenth end 177 of the crossbeam 149 in the manner of a cantilever. The fifteenth end 175 of the eighth arm 148 is free. The sixteenth end 176 of the eighth arm 148 attaches to the eighteenth end 178 of the crossbeam 149 in the manner of a cantilever.

A caster selected from the plurality of casters 112 attaches to the thirteenth end 173 of the seventh arm 147 along the inferior surface of the seventh arm 147. A caster selected from the plurality of casters 112 attaches to the seventeenth end 177 of the crossbeam 149 along the inferior surface of the crossbeam 149. A caster selected from the plurality of casters 112 attaches to the fifteenth end 175 of the eighth arm 148 along the inferior surface of the eighth arm 148. A caster selected from the plurality of casters 112 attaches to the eighteenth end 178 of the crossbeam 149 along the inferior surface of the crossbeam 149.

The following definitions were used in this disclosure:

Cant: As used in this disclosure, a cant is an angular deviation from one or more reference lines (or planes) such as a vertical line (or plane) or a horizontal line (or plane).

Cantilever: As used in this disclosure, a cantilever is a beam or other structure that projects away from an object and is supported on only one end.

Caster: As used in this disclosure, a caster is a wheel that mounts on a swivel that allows the wheel to adjust, or swivel, the direction of rotation of the wheel to the direction of motion desired for the wheel.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned.

When the center axes of two cylinder, prism or pyramidal structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Detent: As used in this disclosure, a detent is a device for positioning and holding one mechanical part in relation to another mechanical part.

Elevation: As used in this disclosure, elevation refers to the span of the distance in the superior direction between a specified horizontal surface and a reference horizontal surface. In this disclosure, the specified horizontal surface is the supporting surface.

Extension Apparatus: As used in this disclosure, an extension apparatus is a mechanical structure that is used to extend the span of the distance between any two objects or the reach of a first object towards a second object.

Extension Structure: As used in this disclosure, an extension structure is an inert physical structure that is used to extend the span of the distance between any two objects.

Gusset: As used in this disclosure, a gusset is an angled structural member used to form a portion of the load path of a section of a framework. By angled is meant that the gusset is neither parallel nor perpendicular to the force of gravity.

Hinge: As used in this disclosure, a hinge is a device that permits the turning, rotating, or pivoting of a first object relative to a second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of the length of the first arm roughly equals the span of the length of the second arm. Hyoids generally have a U shaped appearance.

Inferior: As used in this disclosure, the term inferior refers to a directional reference that is parallel to and in the same direction as the force of gravity.

Inner Dimension: As used in this disclosure, the term inner dimension describes the span from a first inside or interior surface of a container to a second inside or interior surface of a container. The term is used in much the same way that a plumber would refer to the inner diameter of a pipe.

Lateral: As used in this disclosure, the term lateral refers to motion in a direction that is perpendicular to the direction of the force of gravity.

Load Path: As used in this disclosure, a load path refers to a chain of one or more structures that transfers a load generated by a raised structure or object to a foundation, supporting surface, or the earth.

Lock: As used in this disclosure, a lock is a fastening device that secures a rotating mechanical device into a fixed position.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pedestal: As used in this disclosure, a pedestal is an intermediary load-bearing structure that that transfers a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rectangular Block: As used in this disclosure, a rectangular block refers to a three-dimensional structure comprising six rectangular surfaces formed at right angles. Within this disclosure, a rectangular block may further comprise rounded edges and corners.

Rim: As used in this disclosure, a rim is an outer edge or border that follows along the perimeter of an object.

Roll: As used in this disclosure, the term roll refers to the motion of an object that is facilitated by the rotation of one or more wheels or casters.

Rounded: A used in this disclosure, the term rounded refers to the replacement of an apex, vertex, or edge or brink of a structure with a (generally smooth) curvature wherein the concave portion of the curvature faces the interior or center of the structure.

Rim: As used in this disclosure, a rim is an outer edge or border that follows along the perimeter of an object.

Stanchion: As used in this disclosure, a stanchion refers to an upright pole, post, or support.

Superior: As used in this disclosure, the term superior refers to a directional reference that is parallel to and in the opposite direction of the force of gravity.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Telescopic: As used in this disclosure, telescopic is an adjective that describes an object made of sections that fit or slide into each other such that the object can be made longer or shorter by adjusting the relative positions of the sections.

Universal Joint: As used in this disclosure, a universal joint is a method of joining a first shaft to as second shaft such that the center axis of the first shaft and is offset from the center axis of the second shaft. When a universal joint is formed with a locking mechanism, the universal joint can further be used to lock the angle between the first shaft and the second shaft into a fixed position. Universal joints are often used to transfer rotation from the first shaft to rotate the second shaft.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mobile tray comprising
a wheeled base, a stanchion, a gusset, a table, and a plurality of pivots;
wherein the plurality of pivots: a) attach the gusset to the stanchion; and, b) the table to the gusset;
wherein the stanchion pivots for storage;
wherein the gusset pivots for storage;
wherein the table pivots for storage;
wherein the mobile tray is configured for use with a furniture item selected from the group consisting of a bed and a chair;
wherein the wheeled base of the mobile tray is designed to fit underneath the selected furniture item;
wherein the wheeled base is a pedestal structure;
wherein the wheeled base transfers the load path of the mobile tray to a supporting surface;
wherein the wheeled base is a rolling structure;
wherein the stanchion is an extension apparatus;
wherein the span of the length of the stanchion is adjustable;
wherein the stanchion is a telescopic structure;
wherein the stanchion attaches the gusset to the wheeled base;
wherein the stanchion rotates from a position perpendicular to a hyoid of the wheeled base to a position parallel to the hyoid;
wherein the gusset is an extension apparatus;
wherein the span of the length of the gusset is adjustable;
wherein the gusset is a telescopic structure;
wherein the gusset attaches the table to the stanchion;
wherein the gusset rotates relative to the stanchion such that a cant is formed between the center axis of the stanchion and the center axis of the gusset;
wherein the table forms a plurality of work surfaces;
wherein each of the plurality of pivots is a fastening device;
wherein each of the plurality of pivots is a locking device;
wherein each of the plurality of pivots is a rotating device.

2. The mobile tray according to claim 1
wherein the wheeled base comprises a hyoid, a plurality of casters, and a stanchion mount;
wherein the stanchion mount and the plurality of casters attach to the hyoid;
wherein the stanchion mount attaches the stanchion to the wheeled base.

3. The mobile tray according to claim 2
wherein the hyoid has a U shaped structure;
wherein the U shape of the hyoid fits around one or more legs of a furniture item selected from the group consisting of a bed and a chair during the positioning of the table;
wherein each of the plurality of casters is a rolling structure.

4. The mobile tray according to claim 3
wherein the hyoid comprises a first arm, a second arm, and a crossbeam;
wherein the first arm is a rectangular block;
wherein the second arm is a rectangular block;
wherein the crossbeam is a rectangular block;
wherein the crossbeam attaches the first arm to the second arm;
wherein the first arm is further defined with a first end and a second end;
wherein the second arm is further defined with a third end and a fourth end;
wherein the crossbeam is further defined with a fifth end and a sixth end.

5. The mobile tray according to claim 4
wherein the first arm attaches to the crossbeam in the manner of a cantilever;
wherein the second arm attaches to the crossbeam in the manner of a cantilever.

6. The mobile tray according to claim 5 wherein each of the plurality of casters attaches to the inferior surface of the hyoid.

7. The mobile tray according to claim 6
wherein the stanchion mount is a rectangular block structure;
wherein the stanchion mount attaches to the crossbeam of the hyoid;
wherein the stanchion mount is a rotating structure;
wherein the stanchion mount rotates such that the stanchion rotates from a position perpendicular to the hyoid to a position parallel to the hyoid.

8. The mobile tray according to claim 7
wherein the stanchion mount further comprises a stanchion cavity;
wherein the stanchion cavity is a cavity formed in the stanchion mount;
wherein the stanchion cavity is geometrically similar to the third arm of the stanchion such that the stanchion inserts into the stanchion cavity to attach the stanchion to the wheeled base.

9. The mobile tray according to claim 8
wherein the stanchion comprises a third arm, a fourth arm, a fifth arm, a first detent, and a second detent;
wherein the first detent is a mechanical device;
wherein the second detent is a mechanical device;
wherein the first detent attaches the third arm to the fourth arm;
wherein the second detent attaches the fourth arm to the fifth arm;
wherein the third arm is further defined with a seventh end and an eighth end;
wherein the fourth arm is further defined with a ninth end and a tenth end;
wherein the fifth arm is further defined with an eleventh end and a twelfth end.

10. The mobile tray according to claim 9
wherein the third arm is a hollow prism that is further defined with an inner dimension;
wherein the fourth arm is a hollow prism that is further defined with an inner dimension and an outer dimension;
wherein the fifth is a hollow prism that is further defined with an outer dimension;
wherein the fourth arm is geometrically similar to the third arm;
wherein the fifth arm is geometrically similar to the fourth arm;
wherein the span of the outer dimension of the fourth arm is lesser than the span of the inner dimension of the third arm such that the fourth arm inserts into the third arm in a telescopic fashion;
wherein the span of the outer dimension of the fifth arm is lesser than the span of the inner dimension of the fourth arm such that the fifth arm inserts into the fourth arm in a telescopic fashion;
wherein the length of the stanchion adjusts by adjusting the relative position of the fourth arm within the third arm;
wherein the length of the stanchion further adjusts by adjusting the relative position of the fifth arm within the fourth arm;
wherein the position of the fourth arm relative to the third arm is held in position using the first detent;
wherein the position of the fifth arm relative to the fourth arm is held in position using the second detent.

11. The mobile tray according to claim 10
wherein the gusset comprises a sixth arm, a seventh arm, and a third detent;
wherein the third detent is a mechanical device;
wherein the third detent attaches the sixth arm to the seventh arm;
wherein the sixth arm is further defined with a thirteenth end and a fourteenth end;
wherein the seventh arm is further defined with a fifteenth end and a sixteenth end.

12. The mobile tray according to claim 11
wherein the sixth arm is a hollow prism that is further defined with an inner dimension;
wherein the seventh arm is a hollow prism that is further defined with an outer dimension;
wherein the seventh arm is geometrically similar to the sixth arm;
wherein the span of the outer dimension of the seventh arm is lesser than the span of the inner dimension of the sixth arm such that the seventh arm inserts into the sixth arm in a telescopic fashion;
wherein the length of the gusset adjusts by adjusting the relative position of the seventh arm within the sixth arm;
wherein the position of the seventh arm relative to the sixth arm is held in position using the third detent.

13. The mobile tray according to claim 12
wherein the table comprises a horizontal plate, a canted plate, a lip, and an eighth arm;
wherein the eighth arm is further defined with a seventeenth end and an eighteenth end;
wherein the eighth arm is a cylindrical shaft structure;
wherein the eighth arm attaches to the horizontal plate;
wherein the horizontal plate attaches to the eighth arm such that the horizontal plate will not rotate relative to the eighth arm;
wherein the horizontal plate is a rectangular plate structure;
wherein the canted plate is a rectangular plate structure;
wherein the lip is a rim formed on the canted plate.

14. The mobile tray according to claim 13
wherein the plurality of pivots comprises a first pivot and a second pivot;
wherein the first pivot is a locking universal joint;
wherein the first pivot attaches the stanchion to the gusset such that the cant adjusts between the center axis of the stanchion and the center axis of the gusset;
wherein the first pivot locks the cant between the stanchion and the gusset into a fixed position;
wherein the second pivot is locking universal joint;
wherein the second pivot attaches the gusset to the eighth arm such that the cant adjusts between the center axis of the gusset and the center axis of the eighth arm;
wherein the second pivot locks the cant between the gusset and the eighth arm into a fixed position.

15. The mobile tray according to claim 14
wherein the plurality of pivots further comprises a third pivot;
wherein the third pivot is a locking hinge;
wherein the third pivot attaches the horizontal plate to the canted plate such that the cant adjusts between the superior surface of the horizontal plate and the superior surface of the canted plate;
wherein the third pivot locks the cant between the horizontal plate and the canted plate into a fixed position.

16. The mobile tray according to claim 15
wherein the first pivot attaches the stanchion to the gusset such that the cant between the center axis of the stanchion and the center axis of the gusset is adjustable;
wherein the second pivot attaches the gusset to the eighth arm such that the cant between the center axis of the gusset and the center axis of the eighth arm is adjustable;
wherein the third pivot attaches the horizontal plate to the canted plate such that the superior face of the canted plate rotates relative the superior face of the horizontal plate.

17. The mobile tray according to claim 16
wherein the seventh end of the third arm inserts into the stanchion cavity of the stanchion mount;

wherein the ninth end of the fourth arm inserts into the eighth end of the third arm;

wherein the eleventh end of the fifth arm inserts into the tenth end of the fourth arm;

wherein the first pivot attaches the twelfth end of the fifth arm to the thirteenth end of the sixth arm;

wherein the fifteenth end of the seventh arm inserts into the fourteenth end of the sixth arm;

wherein the second pivot attaches the sixteenth end of the seventh arm to the seventeenth end of the eighth arm;

wherein the eighteenth end of the eighth arm attaches to the horizontal plate of the table;

wherein the third pivot attaches the horizontal plate of the table to the canted plate of the table.

18. The mobile tray according to claim 17 wherein the first end of the first arm is free;

wherein the second end of the first arm attaches to the fifth end of the crossbeam in the manner of a cantilever;

wherein the third end of the second arm is free;

wherein the fifth end of the second arm attaches to the sixth end of the crossbeam in the manner of a cantilever.

19. The mobile tray according to claim 18 wherein a caster selected from the plurality of casters attaches to the thirteenth end of the first arm along the inferior surface of the first arm;

wherein a caster selected from the plurality of casters attaches to the fifth end of the crossbeam along the inferior surface of the crossbeam;

wherein a caster selected from the plurality of casters attaches to the third end of the second arm along the inferior surface of the second arm;

wherein a caster selected from the plurality of casters attaches to the sixth end of the crossbeam along the inferior surface of the crossbeam.

* * * * *